United States Patent [19]

Clavin

[11] 4,031,590

[45] * June 28, 1977

[54] PIPE SCRAPER

[75] Inventor: Edward Albert Clavin, Houston, Tex.

[73] Assignee: Midcon Pipeline Equipment Co., Houston, Tex.

[ * ] Notice: The portion of the term of this patent subsequent to Aug. 31, 1993, has been disclaimed.

[22] Filed: Sept. 9, 1975

[21] Appl. No.: 611,696

Related U.S. Application Data

[62] Division of Ser. No. 534,823, Dec. 20, 1974, Pat. No. 3,977,331.

[52] U.S. Cl. ..... 15/104.17; 15/104.18

[51] Int. Cl.² ..... B08B 9/02

[58] Field of Search ..... 15/104.17, 104.18, 104.19

[56] References Cited

UNITED STATES PATENTS

| | | | |
|---|---|---|---|
| 775,677 | 11/1904 | Healey | 15/104.3 R |
| 2,038,170 | 4/1936 | Flavin | 15/104.18 X |
| 2,219,555 | 10/1940 | Burwell | 15/104.18 |
| 2,278,026 | 3/1942 | Smith | 15/104.3 R |
| 2,304,023 | 12/1942 | Sandin | 15/104.18 |
| 2,930,059 | 3/1960 | Frank | 15/104.18 |
| 2,932,837 | 4/1960 | Ver Nooy | 15/104.18 |
| 2,957,189 | 10/1960 | Nelson et al. | 15/104.19 X |

FOREIGN PATENTS OR APPLICATIONS

| | | | |
|---|---|---|---|
| K24,557 | 11/1956 | Germany | 15/104.18 |
| 60,491 | 2/1939 | Norway | 15/104.18 |

*Primary Examiner*—Edward L. Roberts
*Attorney, Agent, or Firm*—Carl B. Fox, Jr.

[57] ABSTRACT

Apparatus for scraping the interior sides of the walls of pipes, having retractable scraper elements at each end of a carrier body or at only one end thereof. The scraper apparatus is preferably moved in both directions through a pipe, the trailing scraper elements preferably being retracted during movement of the apparatus in each direction. The apparatus is particularly designed for removal of coating materials such as cosmoline from pipes before use of the pipes in pipelines.

16 Claims, 9 Drawing Figures

Fig. 5
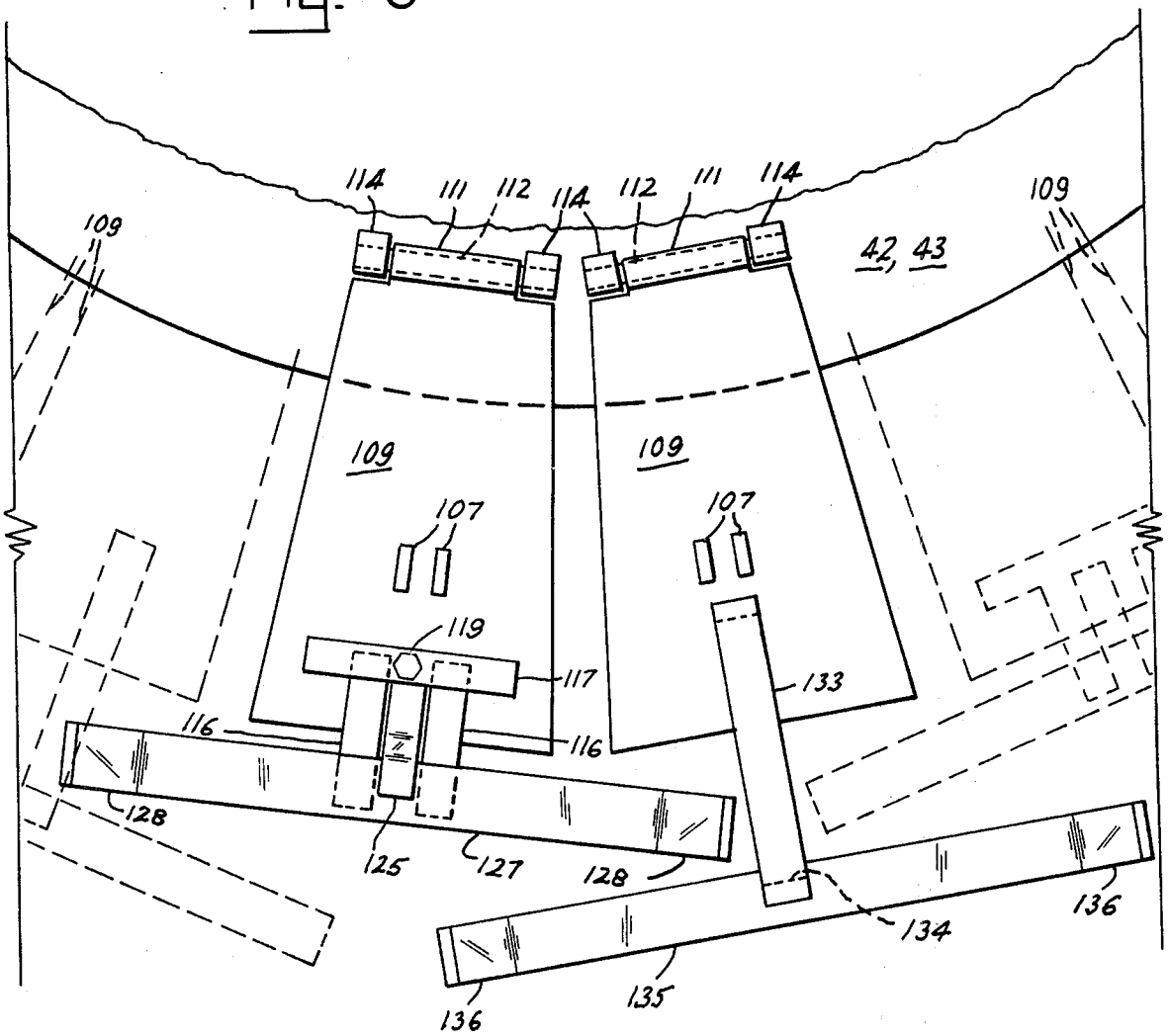
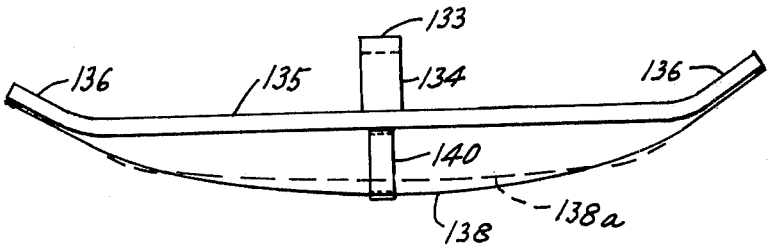
Fig. 6

Fig. 7
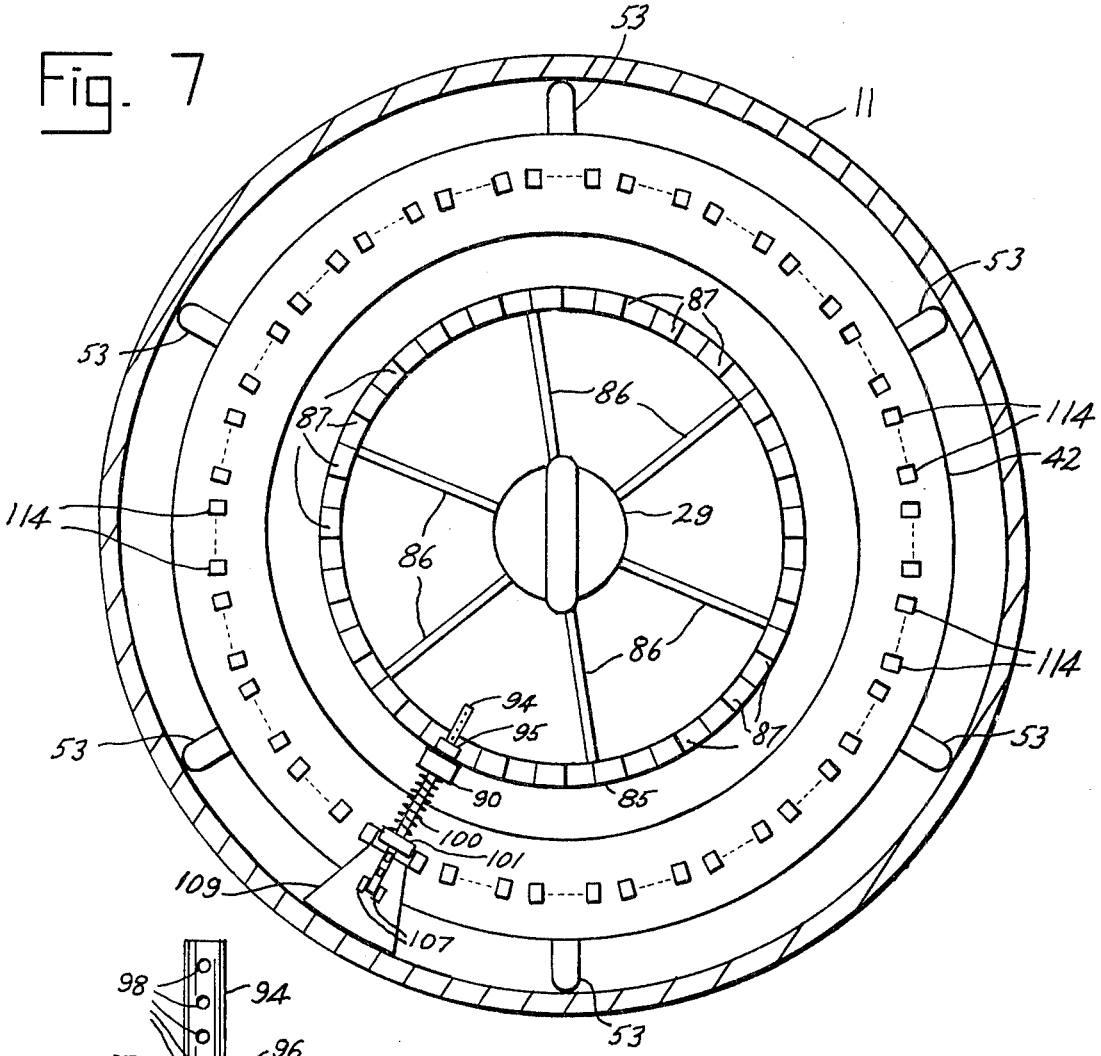
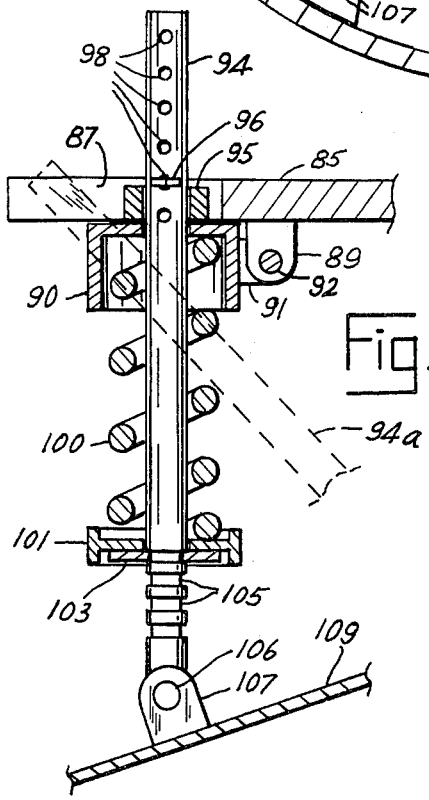
Fig. 8
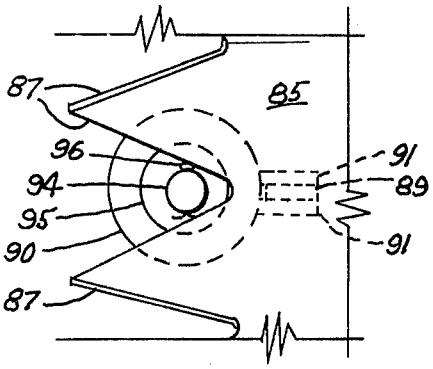
Fig. 9

PIPE SCRAPER

This application is a division of application Ser. No. 534,823, filed Dec. 20, 1974, now U.S. Pat. No. 3977,331, of the same title.

BACKGROUND OF THE INVENTION

For protection of pipe to prevent corrosion, the pipe is often coated at its interior with a continuous pipe coating, cosmoline type substances being an example of the types of materials which may be used for this purpose. The cosmoline type substances are sticky grease-like materials which are difficult to remove. In cold climates, the cosmoline type materials become harder and less sticky, but are still difficult to remove from the pipe surfaces. In order for the pipe lengths to be satisfactorily used in pipeline construction, substantially all of the cosmoline type coating or other coating must be removed.

SUMMARY OF THE INVENTION

The invention provides a scraper apparatus for use in scraping the interiors of pipelines, which includes a movable carriage at one or both ends of which are provided resilient peripheral scraper elements. The scraper elements may be expanded to contact the interior pipe walls, or may be retracted. The scraper apparatus is moved through each section of pipe from end-to-end, and is then preferably again moved through the pipe in the opposite direction, the scraper elements at one end of the carriage performing a first scraping operation in the first direction of travel of the apparatus and then the elements at the other end of the apparatus performing a second scraping operation over the same length or section of pipe in the reverse direction of travel of the apparatus. The scraper elements may take several forms, and must be resilient in order to prevent scratching or digging into the pipe wall and to afford close engagement around the entire interior circumference of the length of pipe.

A principal object of the invention is to provide pipe scraper apparatus suitable for use in scraping coating materials from the interior walls or pipe. Another object of the invention is to provide such pipe scraper apparatus having resilient scraper elements. A further object of the invention is to provide such pipe scraper apparatus having scraper elements at one end or at both ends of a carriage, so that the apparatus is usuable upon movement in opposite directions. Another object of the invention is to provide such pipe scraper apparatus which is economical, dependable, safe, and efficient in use.

Other objects and advantages of the invention will appear from the following detail descriptions of preferred embodiments, reference being made to the accompanying drawings.

BRIEF DESCRIPTIONS OF THE DRAWINGS

FIG. 5 is a partial enlarged plan view of the scraper elements.

FIG. 6 is an enlarged partial side view of a scraper element.

FIG. 7 is a vertical cross section taken at line 7—7 of FIG. 2.

FIG. 8 is an enlarged partial cross section taken at line 8—8 of FIG. 7.

FIG. 9 is an enlarged partial view taken at line 9—9 of FIG. 8.

DESCRIPTIONS OF THE PREFERRED EMBODIMENTS

Figure 1:
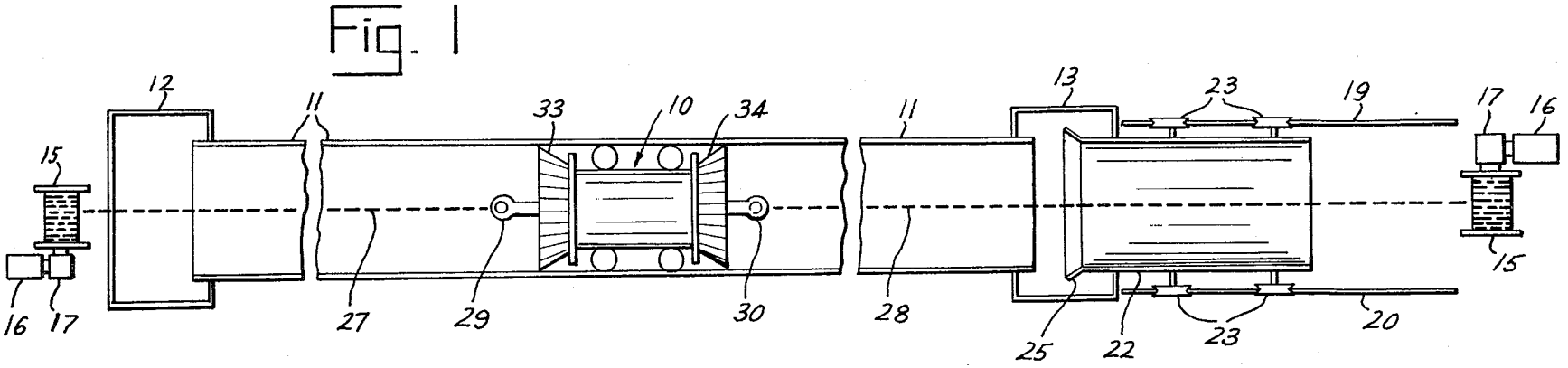
FIG. 1 is a schematic horizontal cross section showing a preferred embodiment of apparatus according to the invention in position for use to scrape the interior of a length of pipe.

Referring now to the drawings in detail, the first to FIG. 1, the scraper apparatus 10 is shown disposed within a length of pipe 11. Pipe length 11 is supported by means not shown with each of its ends above one of the tanks 12, 13. Tanks 12, 13 are used to collect the pipe coating scraped from the pipe and discharged from the ends of the pipe. At each end of the pipe, there is a winch 15 adapted to be driven by an electric motor 16 and gear reducer 17. At one end of the pipe adjacent tank 13 tracks 19, 20 are provided on which is movably disposed a cylindrical nest 22 having wheels 23. Nest 22 is in the form of a length of pipe, and has a conical funnel formation 25 at its end adjacent the end of pipe length 11. Scraper apparatus 10 is stored in nest 22, and is moved in and out of the nest by cables 27, 28. Cables 27, 28 extend from connection rings 29, 30, respectively, of the pipe scraper apparatus to the respective winches 15. Scraper 10 is moved through the pipe in the opposite direction by reeling in cable 28.

The scraping operation commences with movement of the scraper 10 out of nest 22 into the right end of pipe length 11, the scraper traversing the length of the pipe and pushing coating material scraped from the pipe interior into tank 12. The scraper 10 is then moved in the opposite direction by reeling in cable 28, the scraped off material being delivered into tank 13. Preferably, the leading scraper elements 33 are expanded to engage the pipe wall when the scraper 10 is moved toward the left in FIG. 1, the scrapers elements 34 being retracted, and the scraper elements 34 are expanded to contact the pipe wall with the scraper elements 33 retracted upon movement of the scraper 10 toward the right as shown in FIG. 1. Both of the scraper elements 33, 34 are shown in expanded condition in FIG. 1. The scraper may be used in either direction with both sets of scraper elements expanded, but wear on the trailing scraping elements may be reduced by their retraction.

Figure 2:
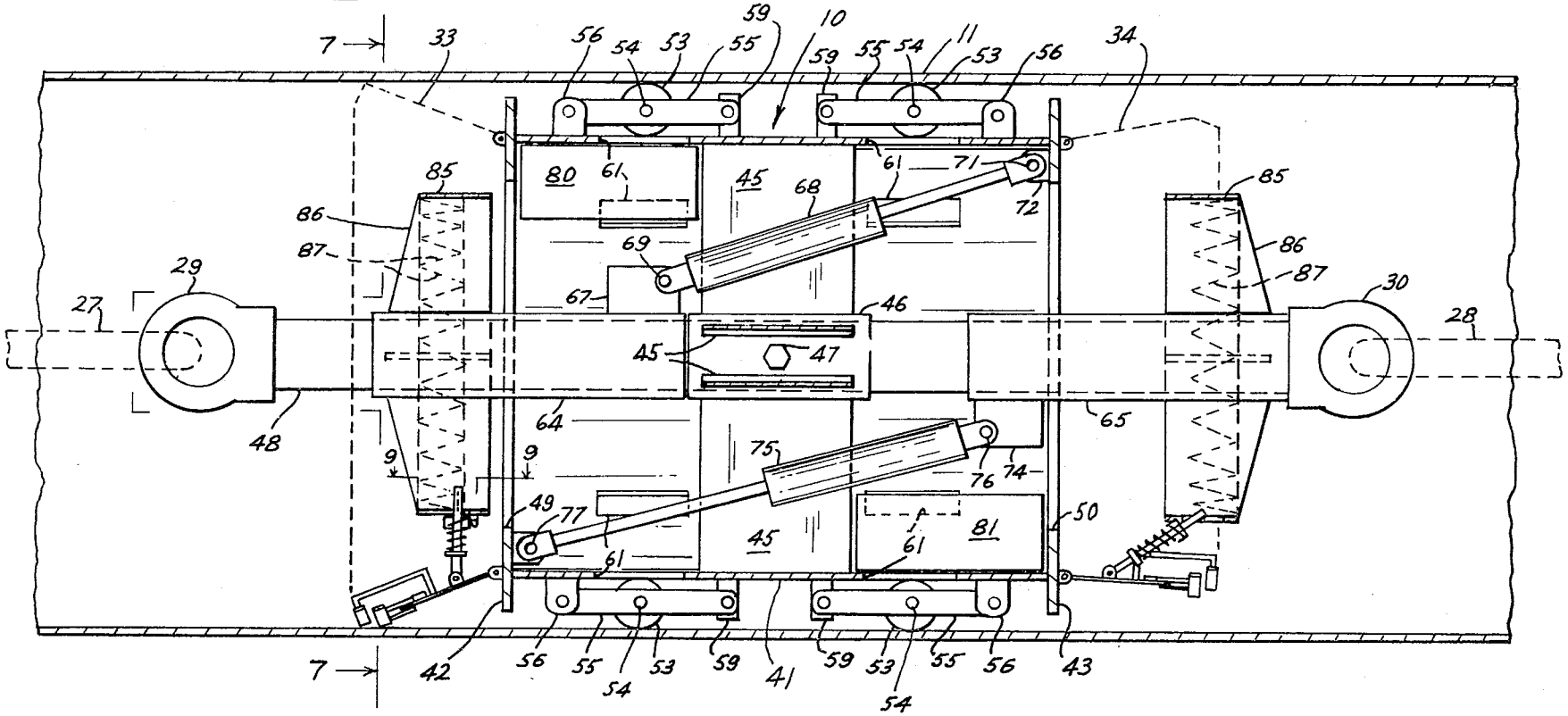
FIG. 2 is an axial cross section of the preferred embodiment of apparatus shown in FIG. 1, the showing of the apparatus being partially schematic.

Referring now also to FIGS. 2–9 of the drawings, scraper 10 has a body or carriage 40 formed by a length of pipe 41 of smaller diameter than pipe 11 and by annular end flange plates 42, 43 which are welded or otherwise suitably affixed to the ends of pipe 41. Some elements are shown rotationally out of position in FIG. 2, e.g., plates 45 and 86, in order that their shapes may be accurately portrayed. Plates 45 and 86 are in the rotational positions shown for plates 86 in FIG. 7. A plurality of plates 45 disposed radially inwardly from pipe 41 support a centered sleeve 46. Six plates 45 are indicated in FIG. 2, these being equally spaced circularly around sleeve 46. A cylindrical bar or shaft 48 is fixed in position through sleeve 46 by bolt 47 through the sleeve and shaft, its ends extending respectively to the left through opening 49 of flange plate 42 and to the right through opening 50 through flange plate 43.

The connector elements 29, 30 are fixed to the respective left and right ends of shaft 48.

The carriage is supported by a plurality of wheels 53. In the drawings, two sets of six wheels 53 each are indicated but other pluralities of wheels may be used and other means permitting travel of the carriage through a pipe may be substituted. Each wheel 53 is supported on an axle 54 extending between two parallel arms 55. At one end, the arms 55 are pivotally connected to a bracket 56. At their other ends, the arms 55 are connected to an adjustment bracket 59 which permits radial adjustment of the arms 55 and wheels 53 in order that the wheels may be brought into contact with the pipe wall. The details of the wheel adjustments are not shown but any suitable form may be used as will be obvious to one skilled in the art. At the location of each wheel 53 there is a slot opening 61 through the wall of pipe 41.

Sleeves 64, 65 of equal length are slidably relatively closely fitted around the shaft 48. Sleeve 64 has bracket 67 to which air cylinder 68 is affixed at pin 69, the opposite shaft end of cylinder 68 being connected by pin 71 to bracket 72 welded or otherwise suitably connected to flange plate 43. Sleeve 65 has bracket 74 to which one end of air cylinder 75 is pivotally connected by pin 76, the opposite shaft end of cylinder 75 being pivotally connected by pin 77 to bracket 78 welded or otherwise suitably connected to flange plate 42. Extension of the air cylinders 68, 75 independently moves the sleeves 64, 65 outward along shaft 48, the outward movement being limited by the connection elements 29, 30 and/or by the stroke of the air cylinders. As is indicated in FIG. 2, when a sleeve 64 or 65 is moved inwardly along shaft 48, the corresponding set of scraper elements 33 or 34 is expanded to contact the pipe wall. When a sleeve 64 or 65 is moved outwardly along shaft 48, then the corresponding set of scraper elements 33 or 34 are retracted inwardly away from the pipe wall.

The air cylinders 68, 75 are operated by compressed air stored in tanks 80, 81 fixed within pipe 41. The air is replenished as necessary. As will be obvious, other means of operating cylinders 68, 75 may be suitably employed.

The scraper elements will now be described. For simplicity and clarity in the drawings, all of the scraper elements are not shown. Only one or two of the scraper elements are shown in each drawing, the locations and structures of the others being apparent from the drawings and description. A ring 85 is concentrically fixed around the outer end portion of each sleeve 64, 65. The rings 85 are supported by radial plates 86, six being indicated equally circularly spaced around the sleeves 64, 65. The outer edges of rings 85 are scalloped by a plurality of notches 87. Twenty-four notches 87 are indicated in the drawings in FIG. 7, but any other suitable plurality of notches may be used. Referring particularly to FIGS. 2 and 7–9, at the location of each notch 87 a perforate bracket 89 is affixed to the outer side of ring 85. A spring cup 90 having a pair of perforate brackets 91 is pivotally connected by pin 92 with bracket 89. A shaft 94 extends through notch 87 and through spring cup 90. The shaft 94 has therearound a collar 95 the outward movement of which is limited by cotter pin 96 disposed through one of a plurality of diametric holes 98 through shaft 94. A helical compression spring 100 has one end engaged within cup 90 and its other end is engaged against a cup 101. Cup 101 is recessed at both its inner and outer sides, a crab washer 103 being disposed therearound around shaft 94 at the location of one of a plurality of annular grooves 105 around shaft 94. The outer end of each shaft 94 is pivotally connected by a pin 106 to a pair of brackets 107 affixed to the inner surface of a scraper plate 109.

A plurality of scraper plates 109 (see FIG. 5) are disposed around each flange plate 42, 43. Plates 109 each have a sleeve 111 at their inner ends through which a pin 112 is disposed to connect the plate 109 to flange plate 42 or 43 by a pair of perforate brackets 114 affixed to flange plate 42 or 43. The plates 109 are therefore pivotal about pins 112. The plates 109 are moved toward the inner surface of pipe 11 on outward movement and away therefrom on inward movement. Simultaneous inward and outward movements of the pivotal plates 109 is controlled by movement of the sleeves 64, 65 and rings 85. When a ring 85 is moved outwardly of the scraper carriage, the shafts 94 each draw the scraper plate 109 connected thereto radially inward. When the rings 85 are moved inwardly of the carriage, the scraper plates are moved radially outward simultaneously, and are resiliently urged toward the pipe interior by the springs 100. Referring to FIG. 8, the shafts 98 assume angular positions **94*a* when the ring 85 is moved outwardly of the carriage and outwardly of the scraper plates. When a ring 85 is moved inwardly, the shafts 94 are in vertical positions and the springs 100 urge the scraper plates 109 against the pipe wall, the spring ends acting between cup 90 bottomed against ring 85 and cup 101 fixed to shaft 98. The spring compression may be adjusted by moving the crab washers 103 to different slots 105. The overall effective length of the shafts 98 may be adjusted by moving the cotter pins 96 to different holes 98. Therefore, all of the scraper plates 109 of each set 33 and 34** are retracted and expanded simultaneously.

Figure 4:
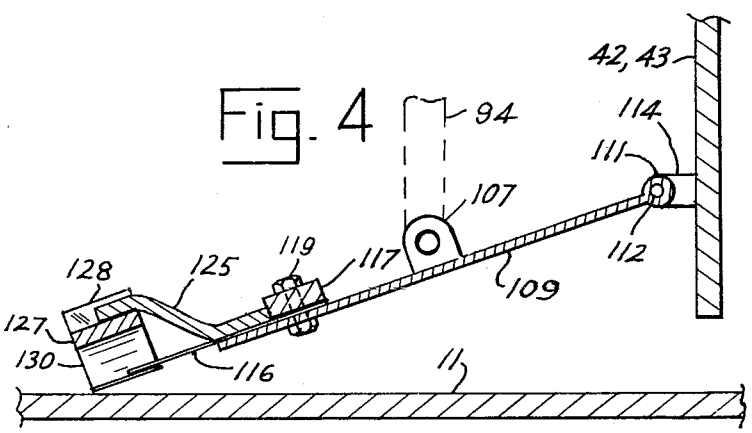
FIGS. 3 and 4 are partial enlarged cross sections of the scraper elements.

Referring now especially to FIGS. 3–6, the scraper plates 109 may themselves by employed to scrape the interior pipe wall. In this case, the scraper fittings shown connected to the outer ends of the scraper plates in FIGS. 3–6 will be omitted and the outer ends of the scraper plates 109 will be used to scrape the coating material from the pipe wall. The plates 109 may be curved at their ends to conform to the curvature of the pipe wall. The outer ends of the scraper plates 109 may be sharpened as indicated at 115 in FIG. 3. However, the scraping action may be improved by attachment of the scraper fittings shown in the drawings. These may take diverse forms. Alternatively, as shown in FIG. 4, one or a plurality of blades 116 may be affixed to each scraper plate 109 by clamping the blades 116 beneath a cross bar 117 clamped to the scraper plate by a bolt 119 and these blades may be used to scrape the coating material from the pipe wall. Other means known in the art may be used for affixing the blade or blades. Here again, the additional scraper fittings shown on the blades are omitted other than those specifically described.

Figure 3:
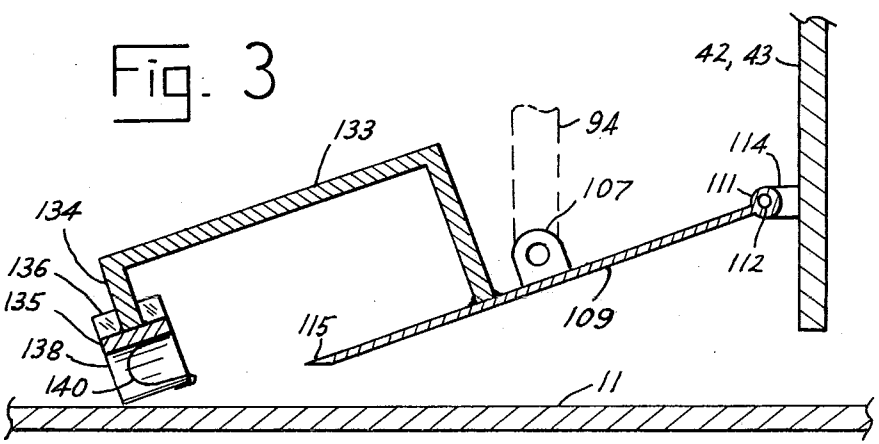

To further improve the scraping action, the complete scraper fittings shown in the drawings may be employed. FIGS. 3 and 4 illustrate the complete assemblies of scraper elements added to the plates 109 that are shown in FIG. 5. Every other plate 109 has one type of scraper fittings while the alternate plates 109 have another form of scraper fittings. The FIG. 4 form of scraper fittings includes a bar 125 curving radially inwardly, which is provided on alternate scraper plates 109. Each bar 125 has affixed to its outer end a cross bar 127 having angularly upturned ends 128. A band 130 of resilient spring metal is affixed between the upturned angular bar ends in the form of a bow. When the scraper fitting is against the pipe wall in scraping position, the strip 130 is reshaped to fit the pipe circumference. In order that the central parts of the band 130 are not bowed upwardly due to pressure against the pipe wall, the strips 116 are provided (which have been described as useful scraper elements of themselves) to maintain the center of each band 130 depressed. This insures that the center of each band is against the pipe wall and the portions to either side along the length of the band 130 then naturally are in engagement with the pipe wall.

Referring now to the FIG. 3 embodiment of scraper element, a bar 133 extends upwardly from each of the alternate scraper plates 109 and is bent outwardly substantially parallel with the plate 109 and then downwardly at 134. A cross bar 135 having angularly upturned ends 136 is affixed to the end of each bar 133. A scraper band 138 of the same type as band 130 but slightly longer, is affixed to each cross bar 135 as indicated in FIG. 6. A spring element 140 is disposed at the center of each scraper element 138 to perform the same function as is performed by the elements 116.

Still referring to FIG. 6, both forms of scraper bands 130, 138 (only scraper bands 138 are shown in FIG. 6) are of the bowed shape shown by the solid line. When the bands are pressed against the pipe wall, the bands 130 and 138 are reshaped as indicated by the dashed line showing 138*a* in FIG. 6 to conform to the arc of the pipe wall. The bands 130, 138 contact the pipe wall under resilient force caused by the springs 100 and the spring properties of the bands themselves, and scrape the pipe wall clean of coating because of the uniform contact.

The sets 33, 34 of scraper plates at the opposite ends of the carriage are preferably rotationally displaced one from the other. In this manner, it can be assured that no strips of unscraped pipe surface will remain after the scraping operation is completed with scraping being done in both longitudinal directions of the pipe.

The apparatus herein described is very effective in removing pipe coatings such as cosmoline, or the like, from the interior walls of a pipe. The scraper elements at one end of the carriage may be omitted, and the apparatus will then be used as when one of the sets of scrapers is retracted. The pipe in which the scraper apparatus is used may be of any suitable length. For example, single or double joint lengths of pipeline pipe may be scraped. The overlapping arrangement of the scraper bands 130, 138, as illustrated in FIG. 5, insures that all surfaces of the pipe are scraped and that an effective scraping job will be accomplished. The materials scraped from the pipe wall is carried along ahead of the scraper apparatus and pushed out ahead of the scraper elements into the tanks 12, 13 in each direction of scraping. When cosmoline coating is cold, as in Alaska in winter, the scraped-off coating rolls up ahead of the scrapers and does not fragment to any extent. Under warmer conditions, the coating if greasy may need to be scraped from the scraper elements at each end of the pipe.

While preferred embodiments of the invention have been described and shown in the drawings, many modifications thereof may be made by a person skilled in the art without departing from the spirit of the invention, and it is intended to protect by letters patent all forms of the invention falling within the scope of the following claims.

I claim:

1. Apparatus for scraping the interior wall of a pipe, comprising carriage means having wheel means for engaging the wall of the pipe whereby said carriage means is movable longitudinally through the pipe, circumferentially segmented scraper means carried at only one end of said carriage means and disposed in a substantially complete circular arrangement around the interior wall of the pipe whereby substantially all of the circumference of the pipe wall will be scraped thereby, said scraper means being expandable against the pipe wall and retractable therefrom, whereby said apparatus may be employed to scrape the interior wall of a pipe when moved through the pipe in one direction.

2. The combination of claim 1, said scraper means comprising plural axially spaced staggered rows of scraper segments each fully engaged with the pipe wall at its outer end.

3. The combination of claim 1, said one end of said carriage means being at least substantially circular at its radially outer edge portion and being of a diameter only slightly smaller than the pipe diameter, said scraper means comprising plural scraper plates uniformly circularly hinged to the radially outer portion of said one end of said carriage means, said scraper means including body means linked to the scraper plates thereof and movable longitudinally of said carriage means in said one direction to draw the scraper plates inwardly to retracted positions and movable longitudinally of said carriage means in the opposite direction to push the scraper plates outwardly to expanded positions against the wall of a pipe within which said apparatus is disposed.

4. The combination of claim 3, including compression spring means for resiliently biasing each said scraper plate radially outward in contact with the wall of a pipe within which said apparatus is disposed.

5. The combination of claim 3, said body means being moved as described by pneumatic means.

6. The combination of claim 5, said pneumatic means comprising an air cylinder.

7. The combination of claim 3, said carriage means having a shaft axially supported therethrough, said body means being slidably disposed on said shaft.

8. The combination of claim 7, including connection means at each end of said shaft for use in drawing said apparatus through a pipe.

9. The combination of claim 3, each said scraper plate having an arcuate outer end adapted to uniformly engage the wall of the pipe to be scraped.

10. The combination of claim 9, said arcuate plate ends being sharpened.

11. The combination of claim 3, each said scraper plate having scraper blade means affixed to its outer end.

12. The combination of claim 11, said scraper blade means comprising thin flat plates.

13. The combination of claim 11, said scraper blade means comprising radially outwardly bowed bands affixed at their ends to the outer faces of said scraper plates and bowed toward the pipe therebetween.

14. Apparatus for scraping the interior wall of a pipe, comprising carriage means movable longitudinally through the pipe, circumferentially segmented circular scraper means carried by said carriage means at only one end thereof, said scraper means being expandable against the pipe wall and retractable therefrom, whereby said apparatus may be employed to scrape the interior wall of a pipe when moved through the pipe; said scraper means comprising plural scraper plates uniformly circularly hinged to said one end of said carriage means, said scraper means including body means linked to the scraper plates thereof and movable longitudinally of said carriage means in one direction to draw the scraper plates inwardly to retracted positions and movable longitudinally of said carriage means in the opposite direction to push the scraper plates outwardly to expanded positions against the wall of a pipe within which said apparatus is disposed, each said scraper plate having scraper blade means comprising radially outwardly bowed bands affixed to its outer end, said bowed bands being disposed in a first inner circumferential row and in a second outer circumferential row, the bands of said first and second rows being circumferentially offset whereby the entire inner pipe wall circumference is lapped by said bands.

15. The combination of claim 14, including means resiliently depressing the central portion of each band outwardly against the pipe wall whereby the bands conform to the pipe wall curvature when biased thereagainst.

16. The combination of claim 15, including means biasing said scraper plates resiliently outward against the wall of a pipe within which said apparatus is disposed.

* * * * *